US006192639B1

(12) United States Patent
Germain

(10) Patent No.: US 6,192,639 B1
(45) Date of Patent: Feb. 27, 2001

(54) STRUCTURAL SYSTEM FOR ERECTING BUILDINGS, PARTICULARLY SINGLE-FAMILY DWELLINGS

(75) Inventor: Roland Patrick Germain, Carrières-sur-Seine (FR)

(73) Assignee: M.I. (FR)

( * ) Notice: Subject to any disclaimer, the term of this patent is extended or adjusted under 35 U.S.C. 154(b) by 0 days.

(21) Appl. No.: 09/155,273

(22) PCT Filed: Jan. 16, 1997

(86) PCT No.: PCT/FR97/00077

§ 371 Date: Dec. 9, 1998

§ 102(e) Date: Dec. 9, 1998

(87) PCT Pub. No.: WO97/26418

PCT Pub. Date: Jul. 24, 1997

(30) Foreign Application Priority Data

Jan. 17, 1996 (FR) ..... 96 00494

(51) Int. Cl.[7] ..... E04B 1/24

(52) U.S. Cl. ..... 52/293.1; 52/293.3; 52/295

(58) Field of Search ..... 52/292, 293.1, 52/293.2, 293.3, 294, 295, 167.1, 167.4, 604, 605, 606, 609, 252, 253, 259, 251

(56) References Cited

U.S. PATENT DOCUMENTS

| | | | | |
|---|---|---|---|---|
| 1,618,886 | * | 2/1927 | Peterson | 52/295 X |
| 4,903,450 | * | 2/1990 | Adams | 52/293.2 |
| 5,584,151 | * | 12/1996 | Abou-Rached | 52/293.2 |
| 5,864,999 | * | 2/1999 | Wallin | 52/293.1 |
| 5,913,793 | * | 6/1999 | Hills | 52/293.3 X |

* cited by examiner

*Primary Examiner*—Richard Chilcot
(74) *Attorney, Agent, or Firm*—Steinberg & Raskin, P.C.

(57) ABSTRACT

A structural system comprising a plurality of tie elements (3) defining the base perimeter of a house, load-bearing metal columns (5) mounted thereon, and a continuous inwardly-open recess extending along the full length of the elements and receiving horizontal reinforcements (18, 19) that form an unbroken chain around the edges of the base. Anchoring reinforcements (12) extend away from the foundation and curve through the elements and along said recess, and hooks (15) are hung from an inwardly projecting portion (14) in such a way that the curved ends of the hooks are located in said recess. The hooks, the horizontal reinforcements and the anchoring reinforcements are all intended to be embedded in concrete cast in the recess. The system is particularly useful for building earthquake-proof single-family dwellings.

13 Claims, 4 Drawing Sheets

STRUCTURAL SYSTEM FOR ERECTING BUILDINGS, PARTICULARLY SINGLE-FAMILY DWELLINGS

FIELD OF THE INVENTION

The present invention relates to a carcassing fabric system for the construction of buildings in particular of single-family home dwelling houses.

BACKGROUND OF THE INVENTION

One already knows such carcassing fabric systems comprising:

a base assembly consisting of a plurality of modular tying concrete elements forming the base perimeter of the outside wall of the house, intended to be anchored into the foundations by reinforced concrete piles and connected to each other by horizontal clamping reinforcements, a bearing structure consisting of metal poles mounted onto the aforesaid tying elements and fastened onto the upper ends of metal crooks which are embedded into the body, generally of trapezoidal shape in cross section, of these elements, an external concrete boarding forming the external peripheral wall of the house, borne by the aforesaid structure and consisting of a plurality of modular bay panels or framings.

These known systems however generally are very heavy to be handled and need the use of also very heavy lifting means, thereby complicating and extending the duration of mounting of the framework.

One has also proposed to use elements of light concrete but its cost is substantially greater than that of the heavy concrete.

Moreover such building systems are not very much earthtremor resistant and do not meet the paraseismic standards in force.

OBJECTS AND SUMMARY OF THE INVENTION

The present invention has therefore as its object to remove the aforesaid inconveniences and to propose a paraseismic carcassing fabric system having a limited weight and which is simple and quick to be mounted.

For that purpose the present invention has as its subject a carcassing fabric system for the construction of buildings in particular of single-family home dwelling houses, comprising:

a base assembly consisting of a plurality of modular concrete tying elements forming the base perimeter of the outside wall of the house and intended to be anchored into the foundation by reinforced concrete piles and connected to each other by horizontal clamping reinforcements, a bearing structure consisting of metal poles which are intended to be mounted onto the aforesaid tying elements and fastened onto the upper ends of metal crooks mounted in these elements, characterized in that an inwards open continuous accommodation space extends over the whole length of the tying elements for receiving the horizontal clamping reinforcements which form an uninterrupted chain over the whole periphery of the base, the aforesaid crooks are suspended at their upper end from a bracket which projects inwards from the tying elements, so that their opposite bent end be located within the aforesaid continuous accommodation space, the reinforcements of the aforesaid anchoring piles extend substantially vertically from the foundations and are curved while extending through the tying elements to extend substantially horizontally within the aforesaid continuous accommodation space, preferably above the bent ends of the crooks, all of the crooks, of the horizontal clamping reinforcements and of the reinforcements of the anchoring piles being intended to be embedded into a concrete slab cast on the spot into the aforesaid continuous accommodation space to ensure a closely linked connection therebetween and to permit the continuity and the transmission of the forces exerted upon the house at the foundations, thereby making the system paraseismic.

In view of the presence of the continuous accommodation space over the whole length of the tying elements, the body of the latter exhibits a substantially L-like or C-like shape in cross-section, thereby substantially reducing their weight.

According to another characteristic of the invention, the horizontal clamping reinforcements consist of several horizontal bars, for example four bars arranged into a parallelogram and of several transverse metal frames connecting the bars to each other, preferably arranged at regular spacings and confined inside of the aforesaid continuous accommodation space.

According to still another characteristic of the invention, the crooks, the anchoring piles and the metal poles of the external structure are substantially aligned in a vertical direction.

In an alternative embodiment, the aforesaid bracket may consist of a plurality of projecting portions spaced from each other on the internal upper edge of the tying elements, so that at least two crooks be suspended from each projecting portion.

In this case, one may provide that the reinforcement of an anchoring pile comprises at least two bars which extend vertically from the foundations between the crooks of a same projecting portion and are horizontally curved within the continuous accommodation space in opposite directions, respectively.

One may provide as a modification that the aforesaid bracket consists of a provisional placement jig for retaining the crooks before the casting of the concrete into the aforesaid continuous accommodation space.

The invention is also directed to a carcassing fabric system comprising an external boarding of reinforced concrete forming the external peripheral walls of the house, which is carried by the aforesaid bearing structure and consists of a plurality of modular bay panels or framings.

According to another characteristic of the invention, the aforesaid panels are thin slabs of concrete reinforced on their internal face by a network of crossed ribs which are reinforced with metal bars for example of steel.

According to still another characteristic of the invention, the aforesaid metal poles of the bearing structure are mounted onto the tying elements through the medium of a pole foot plate of which one portion is slightly overhanging outwards for going to be inserted into a positioning notch formed onto the internal face of a starting panel and to possibly also serve as a bearing point for this panel.

One may also provide a notch and an associated bracket over the whole length of one of the upper and lower edges, respectively, of each panel to form a space for receiving a watertight sealing joint between two horizontally adjacent panels or between a starting panel and a subjacent tying element.

According to another characteristic, a notch is formed over the whole height of the side edges of each panel or frame to form an intermediate decompression space between two vertically adjacent panels.

In this case, one may stick, over the whole height of the external flange of an I-metal pole, a self-adhesive strip of impregnated foam intended to be compressed during the clamping of the panels or of the frames onto the poles in order to avoid the cracking of these concrete panels or frames and to ensure the air-tightness at the level of the aforesaid decompression space.

According to still another characteristic of the invention, one may embed into the aforesaid panels or frames, fastening sleeves which are anchored onto their internal reinforcements to withstand the pulling-out force during the fastening of these panels or frames onto the bearing structure.

BRIEF DESCRIPTION OF THE DRAWINGS

The invention will be better understood and further objects, characteristics, details and advantages thereof will appear more clearly in the course of the explanatory description which will follow of a presently preferred particular embodiment of the invention, given by illustrative and non limiting way only with reference to the attached diagrammatic drawings in which.

DETAILED DESCRIPTION OF THE INVENTION

Figure 1:
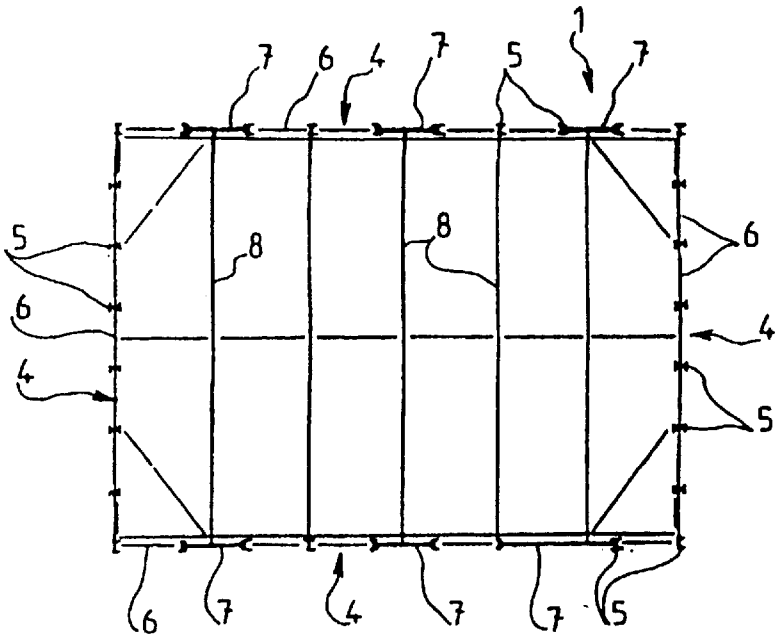
FIG. 1 is a diagrammatic top view of the framework of a single-family home dwelling house.
Figure 2:
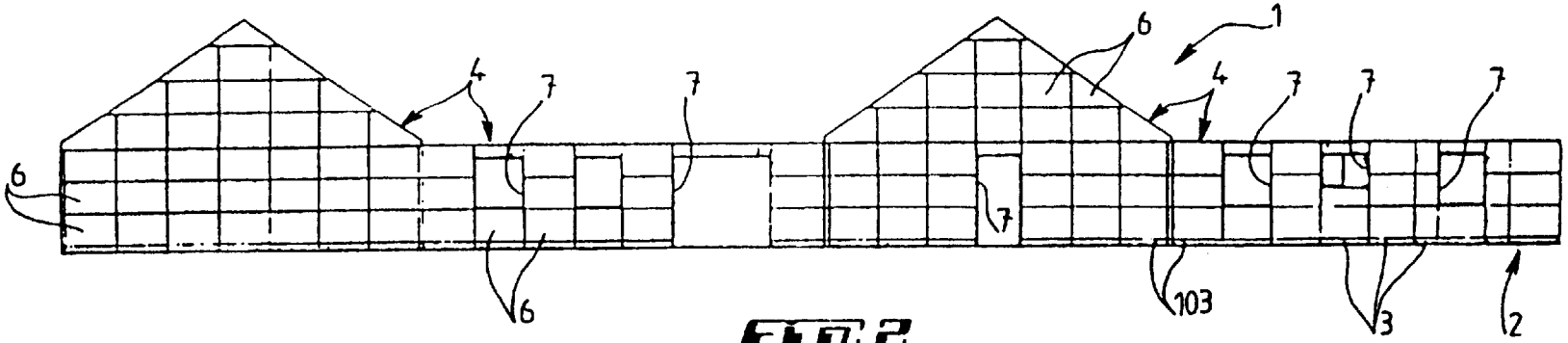
FIG. 2 is a diagrammatic view in side elevation of the developed external boarding of FIG. 1.
Figure 3:
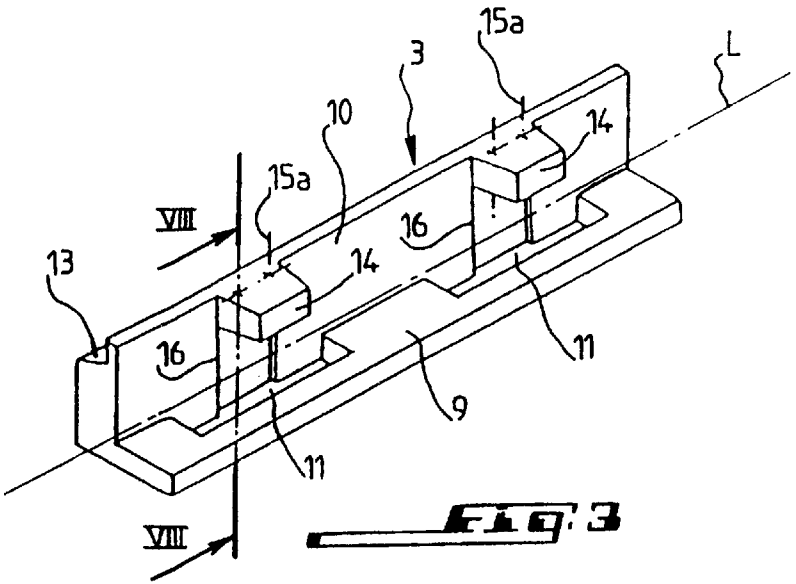
FIG. 3 is a perspective view from the internal side of a running tying element of the system according to the invention.
Figure 5:
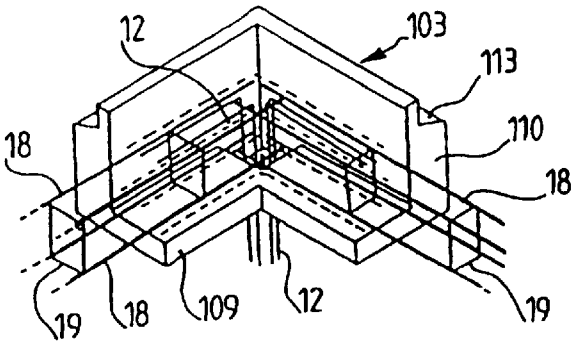
FIG. 5 is a view similar to FIG. 4 but showing a salient angle tying element.
Figure 7:
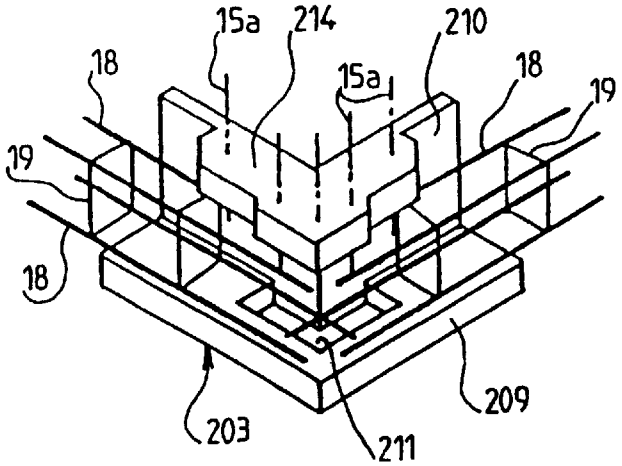
FIG. 7 is a view similar to FIG. 4 but showing a re-entrant angle tying element.
Figure 4:
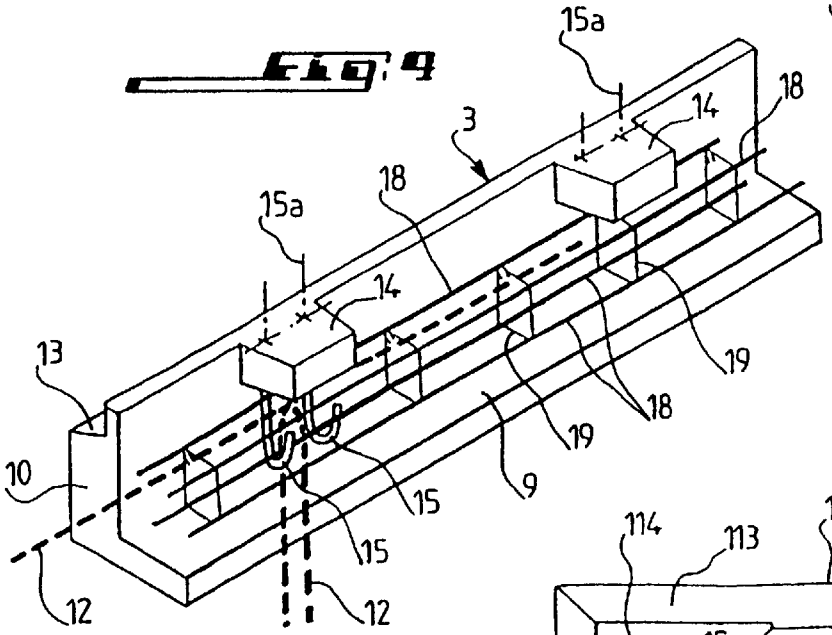
FIG. 4 is a view similar to FIG. 3, showing the different reinforcements associated with the tying element.
Figure 6:
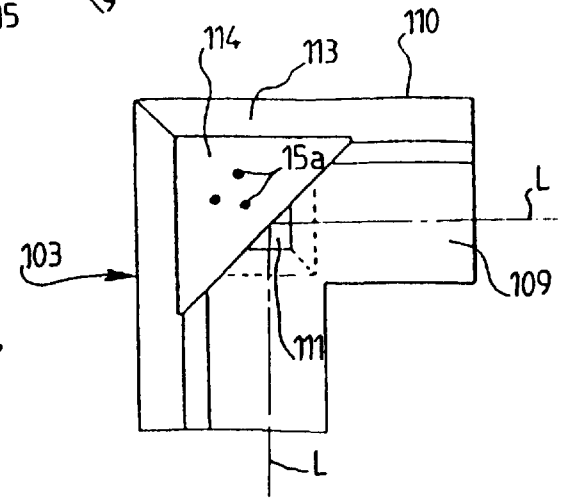
FIG. 6 is a top view of FIG. 5 without the reinforcements.
Figure 12:
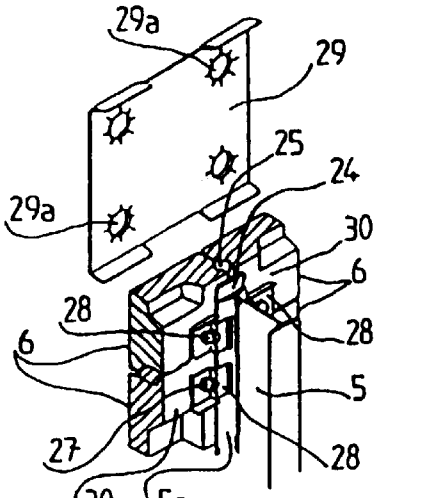
FIG. 12 is a partial perspective view of FIG. 9 according to the arrow XII.
Figure 13:
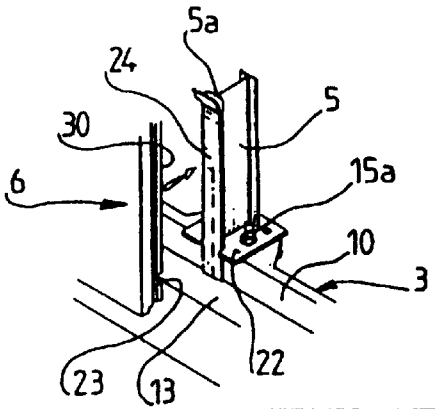
FIG. 13 is a partial perspective view of FIG. 9 according to the arrow XIII prior to the fastening of the panel onto the bearing structure.
Figure 10:
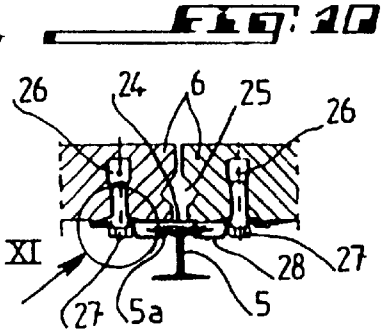
FIG. 10 is a partial view in cross-section of FIG. 9 according to the arrow X.
Figure 11:
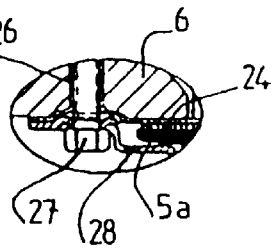
FIG. 11 is a detail view shown by the arrow XI on FIG. 10.
Figure 8:
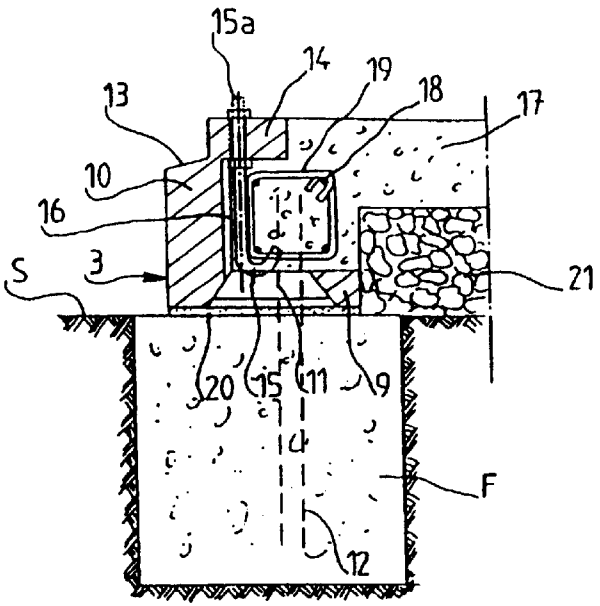
FIG. 8 is a view in cross-section of the tying element of FIG. 3, along the line VIII—VIII in its final mounted state.
Figure 9:
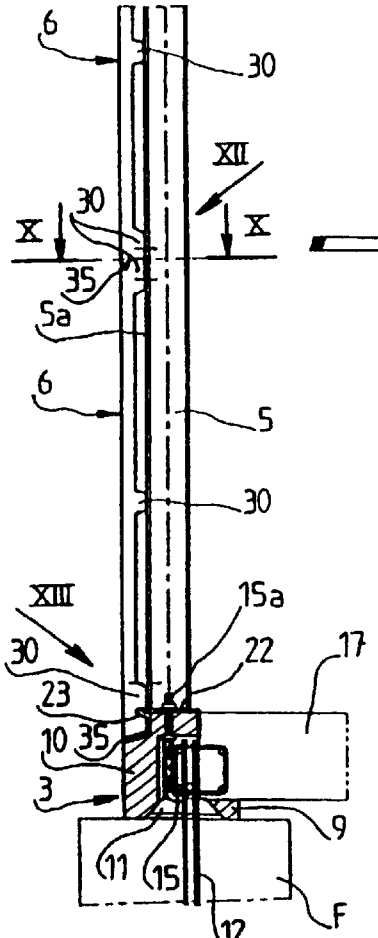
FIG. 9 is a diagrammatic view similar to FIG. 8, showing an external boarding carried by a pole which is mounted onto the tying element.
Figure 16:
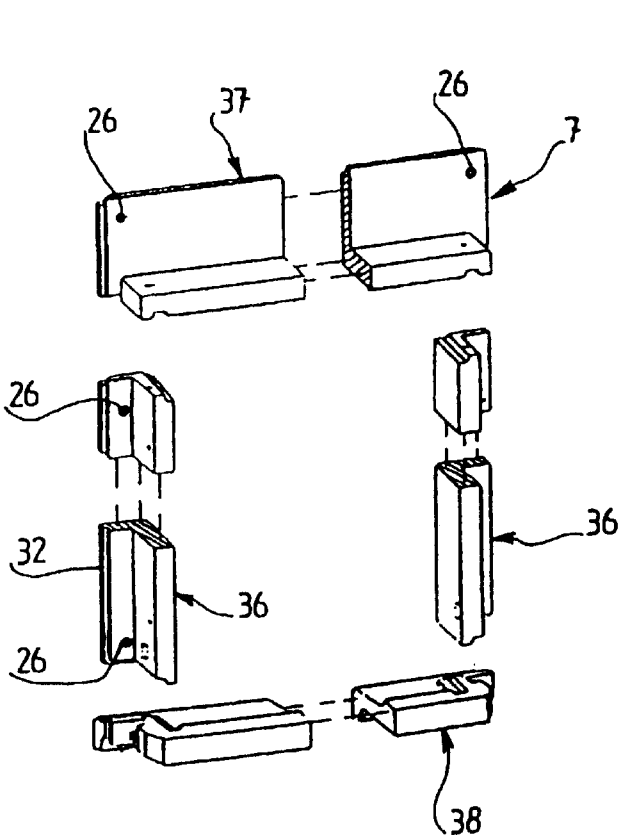
FIGS. 14 to 16 are partial perspective views of the internal face of a running panel, of a starting panel and of a bay frame, respectively.
Figure 15:
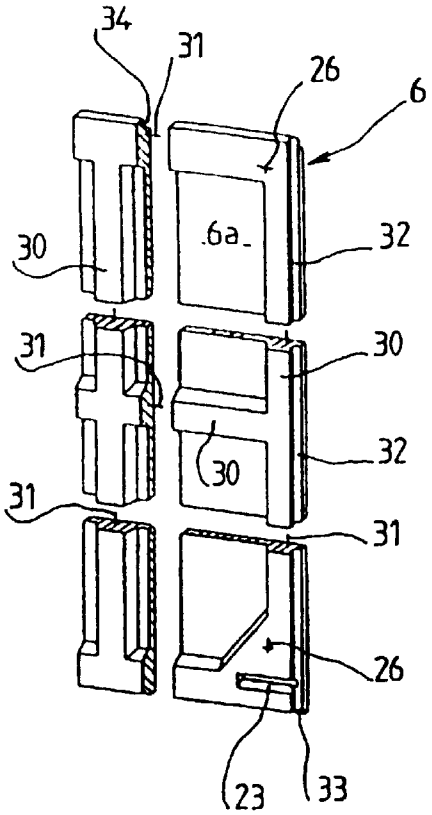
Figure 14:
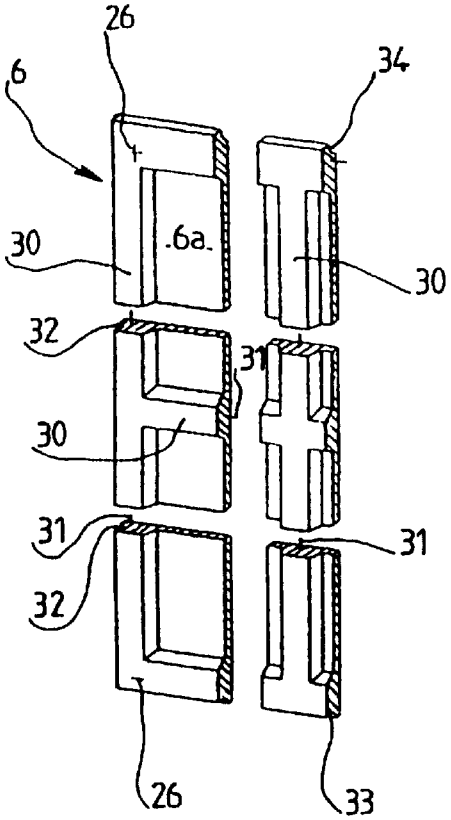

According to the exemplary embodiment shown on the drawings, the carcassing fabric system of the invention comprises an external framework 1 for the construction of a single-family home dwelling house.

This external framework 1 comprises a base 2 consisting of a plurality of concrete tying elements 3, 103 forming the base perimeter of the house and four outside walls 4 consisting of a plurality of vertical metal poles 5 forming the carrying structure and of a plurality of panels 6 and of bay frames 7 carried by the said structure.

One also sees on FIG. 1 the transverse and longitudinal trusses 8 of the framework.

What is claimed is:

1. Carcassing fabric system for the construction of buildings in particular of single-family home dwelling houses comprising:

a base assembly having a plurality of modular concrete tying elements forming a base perimeter for a plurality of outside walls of a house, said base assembly intended to be anchored into a foundation by a plurality of reinforced concrete piles and connected to each other by a plurality of horizontal clamping reinforcements, a bearing structure having a plurality of metal poles mounted onto the tying elements and fastened onto a top end of a plurality of metal crooks mounted within said tying elements, an inwards open continuous accommodation space (L) extending over the whole length of the tying elements (3, 103, 203) for receiving the horizontal clamping reinforcements (18, 19) thereby forming an uniterrupted chain over the whole base perimeter (2), each of the metal crooks comprises an upper end and an opposite lower bent end, each of the crooks (15) depend at their upper ends **(15*a*) from a bracket (14, 114, 214) which projects inwards; from the tying elements such that the lower opposite bent end is located within the continuous accommodation space, and a plurality of anchoring reinforcements (12) of the concrete piles extend substantially vertically from the foundations (F), the anchoring reinforcements are bent while extending through the tying elements in order to extend substantially horizontally into the continuous accommodation space, preferably above the bent ends of the crooks, wherein each of the crooks, of the horizontal clamping reinforcements and of the reinforcements of the anchoring piles, are to be embedded into a concrete slab (17)** cast on site into the continuous accommodation space in order to ensure there exists a close linked connection therebetween and to permit a transmission of forces exerted upon the house at the foundations, thereby making the system paraseismic.

2. The system according to claim 1, wherein the horizontal clamping reinforcements comprise several horizontal bars (18) and several transverse metal frames (19) connecting the bars to one another, preferably arranged at regular spacings and confined inside of the continuous accommodation space (L).

3. The system according to claim 1 wherein the crooks (15), the concrete anchoring piles and the metal poles (5) of the bearing structure are substantially aligned in a vertical direction.

4. The system according to claim 1, wherein the bracket consists of a plurality of projecting portions (14, 214) spaced from each other on an upper internal edge of the tying elements (3, 203) so that at least two crooks depend from each projecting portion.

5. The system according to claim 4, wherein the reinforcement of an anchoring pile further comprises:

at least two bars (12) which extend vertically from the foundations (F), between the crooks (15) of a same projecting portion (14, 214), and are curved into the continuous accommodation space (L) in opposite directions, respectively.

6. The system according to claim 1, wherein the bracket further comprises:

a provisional placement jig (114) for retaining the crooks (15) before the casting of the concrete (17) into the continuous accommodation space.

7. The system according to claim 1, further comprising:

an external reinforced concrete boarding forming one of a plurality of external peripheral walls (4) of the house said walls being carried by the bearing structure (5) and comprise a plurality of panels (6) or of modular bay framings (7).

8. The system according to claim 7, wherein the panels are thin concrete slabs (6) reinforced on an internal face thereof with a network of crossed ribs (30) which are reinforced with metal bars (31).

9. The system according to claim 7, wherein the metal poles (5) are mounted onto the tying elements (3, 103, 203) via a pole foot plate (22), one portion of the pole foot plate slightly protrudes outwards in order to be inserted into a positioning notch (23) formed onto an internal face of a starting panel (6) and to also possibly serve as a bearing point for this panel.

10. The system according to claim 7, wherein a notch (33) and an associated ledge (34) are provided over the entire length of one of a top and a bottom edge, respectively, of each panel thereby forming a space for receiving a water-tight sealing joint (35) between two horizontally adjacent panels (6) or between a starting panel and a subjacent tying panel.

11. The system according to claim 7, wherein a notch (32) is formed over the entire height of each of a side edge of each panel (6) or framing (7) in order to leave an intermediate decompression space (25) between two vertically adjacent panels.

12. The system according to claim 11, wherein a self-adhesive strip of impregnated foam (24), which is bonded over the whole height of an external flange **(5*a*) of a metal I-pole (5), is compressed during the clamping onto the poles of the panels or frames to avoid the cracking of the latter and to ensure the air-tightness at the level of the decompression space (25)**.

13. The system according to claim 7, wherein a plurality of fastening sleeves (26) are embedded into the panels or framings and anchored into the internal reinforcements (31) of the latter to withstand a pullout force during the fastening of the panels or framings onto the bearing structure.

* * * * *